United States Patent [19]

Paszek et al.

[11] Patent Number: 4,576,729

[45] Date of Patent: Mar. 18, 1986

[54] LIQUID DISINFECTANT LAUNDRY DETERGENTS

[75] Inventors: Leon E. Paszek, Mountainside; Barbara Gebbia, Clifton, both of N.J.

[73] Assignee: Sterling Drug Inc., New York, N.Y.

[21] Appl. No.: 633,826

[22] Filed: Jul. 24, 1984

Related U.S. Application Data

[63] Continuation-in-part of Ser. No. 521,858, Aug. 10, 1983, abandoned.

[51] Int. Cl.[4] ..... C11D 3/48; C11D 1/06; C11D 1/86

[52] U.S. Cl. ..... 252/106; 252/173; 252/174.21; 252/174.22; 252/546; 252/547; 252/DIG. 14

[58] Field of Search ..... 252/106, 173, 174.21, 252/174.22, 546, 547, DIG. 14

[56] References Cited

U.S. PATENT DOCUMENTS

| | | | |
|---|---|---|---|
| 3,836,669 | 9/1974 | Dadekian | 424/329 |
| 4,134,840 | 1/1979 | Minegishi et al. | 252/8.9 |
| 4,264,457 | 4/1981 | Beeks et al. | 252/8.75 |
| 4,264,479 | 4/1981 | Flanagan | 252/524 |
| 4,272,395 | 6/1981 | Wright | 252/106 |
| 4,336,152 | 6/1982 | Like et al. | 252/106 |
| 4,336,165 | 6/1982 | Weisenel | 252/528 |

FOREIGN PATENT DOCUMENTS

| | | |
|---|---|---|
| 1137381 | 12/1982 | Canada . |
| 2349323 | 4/1975 | Fed. Rep. of Germany . |
| 60706 | 8/1973 | Japan . |
| 144099 | 11/1980 | Japan . |
| 7408001 | 6/1973 | Netherlands . |

*Primary Examiner*—Prince E. Willis

*Attorney, Agent, or Firm*—William G. Webb; B. Woodrow Wyatt; Paul E. Dupont

[57] ABSTRACT

Stable liquid disinfectant laundry detergent compositions, having germicidal, cleaning, fabric brightening and anti-soil redeposition properties, contain a nonionic surfactant, a cryptoanionic surfactant and a quaternary ammonium germicide and, optionally, minor amounts of other non-essential ingredients.

18 Claims, No Drawings

LIQUID DISINFECTANT LAUNDRY DETERGENTS

CROSS-REFERENCE TO RELATED APPLICATIONS

This application is a continuation-in-part of our prior, co-pending application Ser. No. 521,858, filed Aug. 10, 1983 now abandoned.

BACKGROUND OF THE INVENTION (a) Field of the Invention

This invention relates to stable liquid disinfectant laundry detergent concentrates having valuable anti-soil redeposition properties and to the method of preventing soil redeposition in the washing of textile fabrics by the use thereof.

(b) Information Disclosure Statement

It is well known that certain anti-soil redeposition agents, such as sodium carboxymethylcellulose, can be used in solid, powdered laundry detergents in order to prevent redeposition of soil and thus to prevent graying during the wash cycle. It is also known to use so-called optical brighteners which essentially "mask" the gray coloration produced as a result of soil redeposition. However, the latter approach to fabric brightening is unsatisfactory, because it fails to remove the source of the problem, and furthermore conventional anti-redeposition agents, such as sodium carboxymethylcellulose, cannot be used in liquid laundry detergents, because they tend to separate out of the liquid formulation and thus lose their effectiveness.

Thus Jones et al. Canadian Pat. No. 1,137,381 discloses solid laundry detergent compositions for prevention of static build-up on textile fabrics and for softening the fabrics laundered therewith. The compositions are composed of an anionic surfactant, a non-ionic surfactant and an anti-static agent of the general formula $[R_1R_2R_3R_4N]^+Y^-$ where at least one, but no more than two, of $R_1$, $R_2$, $R_3$ and $R_4$ can be a $C_{16}$–$C_{22}$ aliphatic group, the remainder of the $R_1$, $R_2$, $R_3$ and $R_4$ groups being $C_1$–$C_4$ alkyl, $C_2$–$C_4$ hydroxy-lower-alkyl and "cyclic structures in which the nitrogen atom forms part of the ring" and $Y^-$ is an anion. The ratio of the anionic to the non-anionic surfactants is 2:1 to 15:1, preferably 2:1 to 10:1, and most preferably 3:1 to 6:1. The quaternary ammonium salt is intended to impart anti-static properties to the compositions, and no mention is made by the patentee of any germicidal property resident in the combination. Furthermore, the question of preventing soil redeposition is not addressed by the reference, and thus the reference provides no guidance as to how to overcome that problem in laundry detergents. Moreover the patent does not disclose the use of an alkyl-alkoxy carboxylate as an anionic surfactant, and no mention is made of the adaptation of the formulation to liquid laundry detergents.

Wright U.S. Pat. No. 4,272,395 discloses liquid dishwashing compositions having germicidal properties while retaining good foaming behavior. The compositions are composed of 50–95 parts by weight of a germicidal cationic surfactant of the quaternary ammonium salt type and from 5–50 parts by weight of a co-surfactant of the alkylsulfonate, sulphate, phosphate or carboxylic acid type having from 3 to 8 carbon atoms in the hydrophobic alkyl group and from 0 to 20 parts by weight of a non-ionic surfactant of the mono- or diethanolamide or ethoxylated or propoxylated primary or secondary $C_8$–$C_{16}$ alkanol type containing from 1 to 4 ethyleneoxy or propyleneoxy units per molecule. Being directed to dishwashing detergents, the reference manifestly does not address the problem of soil redeposition in laundry detergents.

Beeks U.S. Pat. No. 4,264,457 discloses laundry detergent/fabric softener/anti-static compositions composed of 3–35 weight percent of a non-ionic surfactant formed from ethylene oxide and a hydrophobic organic compound; 3–30 weight percent of a mono $C_8$–$C_{22}$ long chain aliphatic cationic surfactant of the quaternary ammonium type and an anionic surfactant mixture consisting of a $C_4$–$C_{10}$ alkylsulfate and a $C_{12}$–$C_{22}$ alcohol ethoxylated ether sulfate or carboxylate having from 1 to about 15 moles of ethylene oxide per molecule and where the anionic surfactants are present in a ratio of 1:5 to 5:1 and the cationic:anionic surfactant mole ratio is 0.8:1 to 10:1. The patentee teaches that combinations of di-long chain quaternary ammonium surfactants in liquid detergents are unstable and separate into two phases and also that combinations of anionic and cationic detergents often produce precipitates. The nature of the four or five ingredients, and their relative amounts, are both critical, and the anionic surfactant serves principally to assist in suspending or dissolving the cationic-anionic complex that would otherwise form and separate out. The patentee does not address either the question of imparting germicidal properties to the composition or of preventing soil redeposition. On the contrary, the patentee is primarily concerned with solving the problem of precipitation of the anionic-cationic complex.

SUMMARY OF THE INVENTION

We have surprisingly found that certain carboxylated anionic surfactants, in combination with non-ionic surfactants and cationic germicides, can be combined into liquid laundry detergent formulations having good anti-soil redeposition properties, the carboxylated anionic surfactants surprisingly serving a dual function as surfactants and anti-soil redeposition agents. The finding of such useful combination of properties in liquid laundry detergents is quite surprising in view of the known art relating to laundry detergents.

In a composition of matter aspect, this invention provides a stable liquid laundry detergent concentrate composition, having germicidal, cleaning, fabric brightening and anti-soil redeposition properties, comprising, as essential ingredients, a non-ionic surfactant of the ethoxylated nonyl and octyl phenol type; a cryptoanionic surfactant (i.e. a surfactant of the alkyl alkoxy carboxylate type); and a quaternary ammonium germicide, where the anti-soil redeposition property resides in said cryptoanionic surfactant which thus obviates the need to include other materials known per se to have anti-soil redeposition properties.

In a method aspect, the invention provides a method of preventing soil redeposition in the laundering of textile fabrics which comprises laundering said fabrics in a wash medium containing an effective amount of said stable liquid laundry detergent concentrate composition.

DETAILED DESCRIPTION INCLUSIVE OF THE PREFERRED EMBODIMENTS

More specifically, we have found that, although non-ionic surfactants can be combined with quaternary ammonium germicides to give liquid compositions having detergent and germicidal properties, such compositions are not effective as laundry detergents, because the soil removed from the fabrics is redeposited during the wash cycle thus leaving fabrics with a gray, off-white color.

Equally unsatisfactory results are obtained, we found, when either an anionic surfactant or anionic carboxylated surfactant, that is a so-called cryptoanionic surfactant, is combined with a quanternary ammonium germicide, because such combinations provide only fair detergency, although they do prevent soil redeposition. They are thus not effective as laundry detergents.

Surprisingly, however, we have found that certain critical combinations of a non-ionic surfactant of the ethoxylated nonyl and octyl phenol type with a surfactant of the anionic alkyl alkoxy carboxylate type along with a quanternary ammonium germicide provide stable liquid laundry detergent compositions having good germicidal, cleaning, anti-soil redeposition and brightening properties. Such compositions thus obviate the need to include, in the present compositions, other materials known per se to possess anti-soil redeposition properties in order to provide such properties in the compositions of the invention. These compositions are thus useful as liquid disinfectant laundry detergents.

The invention thus provides stable liquid laundry detergent compositions having germicidal, cleaning anti-soil redeposition and brightening properties consisting essentially of critical relative amounts of:

(A) a non-ionic surfactant of the ethoxylated nonyl and octyl phenol type;

(B) a cryptoanionic surfactant of the alkyl alkoxy carboxylate type;

(C) a quaternary ammonium germicide; and (D) water.

We have found that, in order to provide stable liquid compositions having the desired germicidal, cleaning, brightening and anti-soil redeposition properties, the ratio of A:B:C in the compositions of the invention is critical, and these ingredients should be present in the compositions in ratios of 2:4:1 and 3.5:5:1.

The compositions are prepared by dissolving components A, B and C in water to provide a liquid concentrate in which the total amount of components A, B and C comprises from 30 to 50 weight percent, and preferably around 40 weight percent, of the concentrate, the balance being water. In use, the concentrate is added to the wash water in an amount effective to achieve either cleaning and brightening (through anti-soil redeposition) or such actions as well as sanitization of the fabrics. It has been found that about ¼ cup of the concentrate per wash load is generally adequate to achieve good cleaning and brightening, and from about ¾ cup to about 1½ cups are adequate to achieve cleaning/brightening and sanitization. Thus, based on a total wash water volume of about 10 gallons, the compositions can be used at dilutions of the concentrate from about 0.16% to about 0.94% by volume in water, i.e. from about 1:640 to about 1:107. Based on a total concentration of from 30% to 50% of components A, B and C in the concentrate, these dilutions correspond to about 0.05% to about 0.08% (1:2133 to 1:1280) of components A, B and C in the wash water for good cleaning and brightening and from about 0.14% to about 0.47% (1:711 to 1:213) for cleaning/brightening and sanitization.

The compositions may also, optionally, contain minor amounts, i.e. up to about 13 total weight percent, of non-essential ingredients, such as a foam stabilizer/anti-irritant agent, brighteners, fragrances, dyes, a pH adjuster such as triethanolamine (TEA), and ethanol, the latter used to adjust the viscosity. As stated before, the anti-soil redeposition property in the stable liquid laundry detergent concentrate compositions resides in the cryptoanionic surfactant, thus obviating the need to include other conventional anti-soil redeposition agents, such as sodium carboxymethylcellulose, which form no part of this invention and which are not included among the optional ingredients described above.

The ethoxylated nonyl and octyl phenol type non-ionic surfactants useful in the practice of the present invention have one of the general structural formulas:

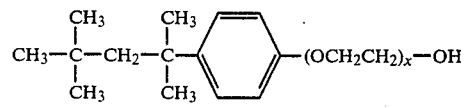

Ia or

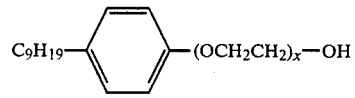

Ib in which the $C_9H_{19}$ group in the compounds of formula Ib is a mixture of branched-chain isomers, and x indicates the average number of $(OCH_2CH_2)$ units in the side chain. Suitable non-ionic surfactants of formulas Ia/Ib useful in the practice of the invention contain from 7 to around 13 $(OCH_2CH_2)$ units. Such compounds are sold under the Rohm and Haas (Philadelphia, Pa.) trade name TRITON® X, and include compounds of this class such as TRITON® X-114 (x is 7–8); TRITON® X-100 (x is 9–10) and TRITON® X-102 (x is 12–13). A preferred non-ionic surfactant of this class is TRITON® X-100.

The anionic alkyl alkoxy carboxylate surfactants, i.e. the cryptoanionic surfactants, designated ingredient B above, have the general structural formula:

$$R—O—(C_nH_{2n}O)_m—R_1—COOM \qquad II$$

where R is a long chain, straight or branched, alkyl group containing from 8 to 18 carbon atoms, n is an integer from 2 to 4, m is an integer from 1 to 100; $R_1$ is $CH_2$, $CH_2CH_2$ or $CH_2CH_2CH_2$; and M is a sodium, potassium, lithium, ammonium, diethylammonium or triethylammonium cation or other cations, including multivalent cations. Surfactants of this class are marketed by Sandoz Specialty Industries, East Hanover, N.J. 07936 as SANDOPAN® and by Finetex Inc., Elwood Park, N.J. 07407 as SURFINE®. A preferred cryptoanionic surfactant of this class useful in the practice of the present invention is SANDOPAN® DTC Gel (R is tridecyl), which is the sodium salt of trideceth-7-carboxylic acid $[C_{13}H_{27}O(CH_2CH_2O)_6CH_2COONa]$.

The quaternary ammonium germicides useful in the practice of the present invention have the structural formula:

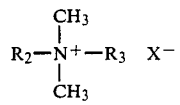

III where $R_2$ and $R_3$ are the same or different $C_8$–$C_{12}$ alkyl, or $R_2$ is $C_{12}$–$C_{16}$ alkyl and $R_3$ is benzyl; and $X^-$ is a halide, for example chloride, bromide or iodide. Such quaternary germicides are usually sold as mixtures of two or more different quaternaries, such as BARDAC® 205M, sold by Lonza Inc., Fair Lawn, N.J., which consists of a 50% aqueous solution containing 20% by weight of an alkyl dimethyl benzylammonium chloride (50% $C_{14}$, 40% $C_{12}$ and 10% $C_{16}$ alkyl); 15.0 weight percent of octyl decyl dimethylammonium chloride; 7.5 weight percent of dioctyl dimethylammonium chloride; and 7.5 weight percent of didecyl dimethylammonium chloride, or CYNCAL® 80%, sold by Hilton Davis Chemical Co., Cincinnati, Ohio, which consists of 80% by weight of an alkyl dimethyl benzylammonium chloride (50% $C_{14}$, 40% $C_{12}$ and 10% $C_{16}$ alkyl), 10% water and 10% ethanol.

Other suitable commercially available quaternary ammonium germicides of the alkyl dimethyl benzylammonium chloride type, containing the same alkyl dimethyl benzylammonium chloride mixture as CYNCAL®, and which are generally referred to as quaternium salts, are BARQUAT® MB-80, sold by Lonza Inc., which is an 80% solution (20% ethanol) of the quaternary, and HYAMINE® 3500, sold by Rohm and Haas Co., which is a 50% aqueous solution of the quaternary.

The compositions can also contain a sequestering agent or detergent builder, such as nitrilotriacetic acid (NTA), optionally in the form of its di- or trisodium salts.

The foam stabilizer/anti-irritant agents, which can optionally be included in the compositions of the invention, are preferably amine oxides of the formula:

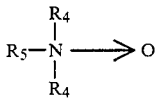

IV where $R_4$ can be hydrogen, methyl, 2-hydroxyethyl or, together with the nitrogen atom, morpholino, and $R_5$ is a long chain $C_{12}$–$C_{18}$ alkyl group. A preferred amine oxide of formula IV in the practice of the present invention is dimethyl cocoamine-N-oxide.

The manner and process of making and using the invention, and the best mode contemplated by the inventors for carrying out the invention, will now be described so as to enable any person skilled in the art to which it pertains to make and to use the same.

EXAMPLES

A series of liquid laundry detergent formulations, within the ambit of the present invention and designated formulations C, E, F, G and H, were formulated as indicated in Table 1 using TRITON® X-100 (as a non-ionic surfactant), SANDOPAN® DTC Gel (as anionic carboxylated surfactant), BARDAC® 205M or CYNCAL® (as a quaternary ammonium germicide), dimethyl cocoamine-N-oxide (AROMOX®, Armak Company, McCook, Ill.) (as foam stabilizer), trisodium NTA and other non-essential ingredients as indicated. For comparative purposes, other formulations, which form no part of this invention and which are designated formulations A, B and D, were also prepared using TRITON® X-100, SANDOPAN® DTC Gel and BARDAC® 205M. Amounts of ingredients are expressed in percent by weight.

TABLE 1

| | Formulation | | | | | | | |
|---|---|---|---|---|---|---|---|---|
| Ingredient | A | B | C | D | E | F | G | H |
| TRITON® X-100 (100%) | 20 | — | 10 | 30 | 10.000 | 18.00 | 18.00 | 18.00 |
| SANDOPAN DTC (100%) | — | 20 | 20 | 10 | 20.000 | 21.50 | 21.50 | 21.50 |
| BARDAC® 205M (50%) | 10 | 10 | 10 | 10 | 8.000 | — | — | — |
| CYNCAL® (80%) | — | — | — | — | — | 7.00 | 7.00 | 7.00 |
| AROMOX® DMC-W (30%) | — | — | — | — | 1.500 | — | — | — |
| Sodium NTA | — | — | — | — | — | — | — | 5.00 |
| Brightener (12%) | — | — | — | — | 0.600 | 3.00 | 3.00 | 3.00 |
| EDTA | — | — | — | — | — | — | 1.00 | — |
| TEA | — | — | — | — | — | 1.00 | — | 1.00 |
| Ethanol | — | — | — | — | — | 4.00 | 4.00 | 4.00 |
| Fragrance | — | — | — | — | 0.500 | 0.50 | 0.50 | 0.50 |
| Dye | — | — | — | — | 0.002 | 0.008 | 0.008 | 0.008 |
| Water | Balance | Balance | Balance | Balance | Balance | Balance | Balance | Balance |
| TOTAL | 100 | 100 | 100 | 100 | 100 | 100 | 100 | 100 |

Each of these formulations was then tested for its cleaning and brightening efficacy, using the detergency test, and for its germicidal efficacy. In the detergency test, for each detergent composition to be evaluated, the reflectancies of four 3"×3" soiled test swatches (from Test Fabrics, 200 Blackford Avenue, Middlesex, N.J. 08846) and an equivalent number of unsoiled swatches used as controls were determined using a reflectometer. The eight test swatches were divided into pairs, one soiled and one unsoiled swatch per pair, and each pair was placed in a separate pot, containing 1 g./liter of the test detergent composition in tap water at 120°–130° F., of a Terg-O-Tometer, Model 7243, supplied by United States Testing Co., Hoboken, N.J. After washing for ten minutes, the test swatches were removed, rinsed in cold tap water, blotted between paper towels and oven dried at 105° F. for 10–15 minutes. Reflectance readings on each of the swatches were then taken again, and the cleaning efficacy, expressed as % Soil Removal, and the whitening ability, expressed as % Whiteness Retention, were calculated for the test swatches as follows, the values obtained for any given detergent formulation being the average of the individual values so determined:

$$\% \text{ Soil Removal} = \frac{R_W - R_S}{R_O - R_S} \times 100$$

where:

$R_W$=Average reflectance of washed soiled cloths $R_S$=Average reflectance of unwashed soiled cloths $R_O$=Average reflectance of unsoiled cloths and $$\% \text{ Whiteness Retention} = \frac{R_X}{R_Y} \times 100$$

where:

$R_X$=Average reflectance of unsoiled white cloth after washing with soiled cloth $R_Y$=Average reflectance of unsoiled white cloth before washing.

In addition, the germicidal activity of each test composition was determined against *K. pneumoniae* ATCC 4352 and *S. aureus* ATCC 6538 using the EPA-approved PetrocciClark test procedure [Proposed Test Method for AntiMicrobial Laundry Additives, Petrocci and Clark, J. Assoc. Off. Anal. Chem. 52, 835–842 (1969)] which is a simulated in-use test method. (See EPA publication DIS/TSS-13, May 2, 1979). The germicidal activity for each formulation was expressed in terms of the maximum dilution effective to obtain germicidal activity.

The results so-obtained in each of the above-described procedures are summarized in Table 2 below. Also included, for comparative purposes, are data for two commercial powdered laundry detergents, designated "Comm. 1" and "Comm. 2", neither of which contains a germicidal agent.

TABLE 2

| Properties | Formulation | | | | | | | | | |
|---|---|---|---|---|---|---|---|---|---|---|
| | A | B | C | D | E | F | G | H | Comm. 1 | Comm. 2 |
| % Soil Removal | 9.10 | 12.84 | 14.05 | 10.66 | 13.53 | 25.15 | 22.45 | 24.21 | 25.20 | 13.30 |
| % Whitness Retention | 74.99 | 90.62* | 89.76 | 75.96 | 90.95 | 91.14 | 90.14 | 88.44 | 94.37 | 84.48 |
| Disinfection | 1:200 | 1:200 | 1:200 | 1:200 | 1:200 | 1:250 | — | 1:333 | None | None |

*Trace of gray present after washing

From these results, it will be seen that formulation A provides only fair cleaning of textile fabrics, characterized by poor anti-soil redeposition but acceptable germicidal properties. Such formulation would typically be used for cleaning hard surfaces but would be totally unsuited for use as a laundry detergent.

In formulation B, the use of an anionic carboxylated surfactant, instead of a non-ionic surfactant as used in formulation A, essentially overcomes the soil redeposition problem inherent in formulation A and also provides acceptable germicidal action. However the formulation gave only fair detergency and furthermore would be commercially unacceptable because of its failure to leave the fabrics white after washing.

As shown by the results obtained with formulation C, the combination of both a non-ionic surfactant and an anionic carboxylated surfactant with a quaternary germicide provides not only acceptable germicidal action and very good cleaning action but good anti-soil redeposition action as well.

The results obtained with formulation D, which gave only fair cleaning action and unacceptable anti-soil redeposition action, show that the relative amounts of the non-ionic and anionic carboxylated surfactants are critical to the overall cleaning and brightening properties of the combination.

Formulation E, which is based on formulation C, contains certain non-essential ingredients which are intended to make the formulation aesthetically more appealing. Also as shown by the data, formulations F, G and H provide excellent cleaning action, good anti-soil redeposition and effective germicidal action.

While the commercial powdered detergents show good to excellent cleaning action and good anti-soil redeposition, they have no germicidal activity at all making them unsuitable for use where such activity is required.

We claim:

1. A stable liquid laundry detergent concentrate composition, which in use has germicidal, fabric brightening, cleaning, and anti-soil redeposition properties, and composition consisting essentially of:

(A) a non-ionic surfactant having the formulas:

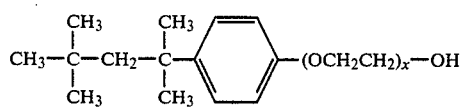

Ia or

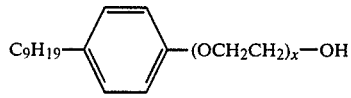

Ib or a mixture thereof in which the $C_9H_{19}$ group in the compounds of formula Ib is a mixture of branched-chain isomers, and x is an integer from 7 to 13;

(B) a cryptoanionic surfactant having the formula:

$$R—O—(C_nH_{2n}O)_m—R_1—COOM \qquad \text{II}$$

where R is a long-chain, straight or branched, alkyl group containing from 8 to 18 carbon atoms, n is an integer from 2 to 4, m is an integer from 1 to 100, $R_1$ is $CH_2$, $CH_2CH_2$ or $CH_2CH_2CH_2$ and M is a sodium, potassium, lithium, ammonium, diethylammonium or triethylammonium cation;

(C) a quaternary ammonium germicide having the formula:

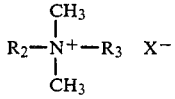

III where $R_2$ and $R_3$ are the same or different $C_8$–$C_{12}$ alkyl, or $R_2$ is $C_{12}$–$C_{16}$ and $R_3$ is benzyl; and $X^-$ is halide; and (D) water, wherein, based on the total weight of A, B, C and D, components A, B and C comprise from 30 to 50 weight percent and wherein the ratio of A:B:C in said composition is in the range from 2:4:1 to 3.5:5:1.

2. A stable liquid laundry detergent concentrate composition according to claim 1 additionally comprising up to about 13 total weight percent of foam stabilizer-/anti-irritant agents, brighteners, fragrances and dyes.

3. A composition according to claim 1 where R is tridecyl.

4. A composition according to claim 2 where R is tridecyl and wherein the foam stabilizer/anti-irritant agent comprises about 0.45% of dimethyl cocoamine-N-oxide.

5. A composition according to claim 3 containing (A) about 10 weight percent of an ethoxylated nonyl and octyl phenol of formula Ia/Ib where x is 9–10; (B) about 20 weight percent of sodium trideceth-7-carboxylate of the formula $C_{13}H_{27}O(CH_2CH_2O)_6OCH_2COONa$ and (C) about 5 weight percent of a quaternary ammonium germicide of formula III containing about 40 weight percent of an alkyl dimethyl benzylammonium chloride (50% $C_{14}$, 40% $C_{12}$ and 10% $C_{16}$ alkyl); about 30.0 weight percent of octyl decyl dimethylammonium chloride; about 15 weight percent of dioctyl dimethylammonium chloride; and about 15 weight percent of didecyl dimethylammonium chloride, and the balance water.

6. A composition according to claim 4 containing (A) about 10 weight percent of an ethoxylated nonyl and octyl phenol of formula Ia/Ib where x is 9–10; (B) about 20 weight percent of sodium trideceth-7-carboxylate of the formula $C_{13}H_{27}O(CH_2CH_2O)_6OCH_2COONa$; (C) about 4 weight percent of a quaternary ammonium germicide of formula III containing about 40 weight percent of an alkyl dimethyl benzylammonium chloride (50% $C_{14}$, 40% $C_{12}$, and 10% $C_{16}$ alkyl); about 30.0 weight percent of octyl decyl dimethylammonium chloride; about 15.0 weight percent of dioctyl dimethylammonium chloride; and about 15 weight percent of didecyl dimethylammonium chloride; and other ingredients comprising about 0.45 weight percent of dimethyl cocoamine-N-oxide, about 0.07 weight percent of a brightener, about 0.5 weight percent of a fragrance oil and about 0.002 weight percent of a dye.

7. A composition according to claim 2 containing (A) about 18 weight percent of an ethoxylated nonyl and octyl phenol of formula Ia/Ib where x is 9–10; (B) about 21.5 weight percent of sodium trideceth-7-carboxylate of the formula $C_{13}H_{27}O(CH_2CH_2O)_6OCH_2COONa$; (C) about 5.6 weight percent of an alkyl dimethyl benzylammonium chloride (50% $C_{14}$, 40% $C_{12}$, 10% $C_{16}$ alkyl); and other ingredients comprising about 0.36 weight percent of a brightener, about 1 weight percent of triethylamine, about 4 weight percent of ethanol, about 0.5 weight percent of a fragrance oil and about 0.008 weight percent of a dye.

8. A composition according to claim 2 containing (A) about 18 weight percent of an ethoxylated nonyl and octyl phenol of formula Ia/Ib where x is 9–10; (B) about 21.5 weight percent of sodium trideceth-7-carboxylate of the formula $C_{13}H_{27}O(CH_2CH_2O)_6OCH_2COONa$; (C) about 5.6 weight percent of an alkyl dimethyl benzylammonium chloride (50% $C_{14}$, 40% $C_{12}$, 10% $C_{16}$ alkyl); and other ingredients comprising about 0.36 weight percent of a brightener, about 1.0 weight percent of ethylenediaminetetraacetic acid, about 4.0 weight percent of ethanol, about 0.5 weight percent of a fragrance oil and about 0.008 weight percent of a dye.

9. A composition according to claim 2 containing (A) about 18 weight percent of an ethoxylated nonyl and octyl phenol of formula Ia/Ib where x is 9–10; (B) about 21.5 weight percent of sodium trideceth-7-carboxylate of the formula $C_{13}H_{27}O(CH_2CH_2O)_6OCH_2COONa$; (C) about 5.6 weight percent of an alkyl dimethyl benzylammonium chloride (50% $C_{14}$, 40% $C_{12}$, 10% $C_{16}$ alkyl); and other ingredients comprising about 5.0 weight percent of trisodium nitrilotriacetate, about 0.36 weight percent of a brightener, about 1.0 weight percent of triethylamine, about 4.0 weight percent of ethanol, about 0.5 weight percent of a fragrance oil and about 0.008 weight percent of a dye.

10. A method of preventing soil redeposition in the laundering of textile fabrics which comprises laundering said fabrics in a wash medium containing a stable liquid laundry detergent concentrate composition consisting essentially of:

(A) a non-ionic surfactant having the formula:

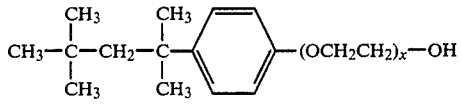

Ia or

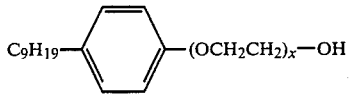

Ib or a mixture thereof in which the $C_9H_{19}$ group in the compounds of formula Ib is a mixture of branched-chain isomers, and x is an integer from 7 to 13;

(B) a cryptoanionic surfactant having the formula:

$$R—O—(C_nH_{2n}O)_m—R_1—COOM$$

where R is a long-chain, straight or branched, alkyl group containing from 8 to 18 carbon atoms, n is an integer from 2 to 4, m is an integer from 1 to 100, $R_1$ is $CH_2$, $CH_2CH_2$ or $CH_2CH_2CH_2$ and M is a sodium, potassium, lithium, ammonium, diethylammonium or triethylammonium cation;

(C) a quaternary ammonium germicide having the formula:

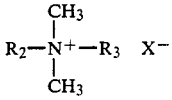

III where $R_2$ and $R_3$ are the same or different $C_8$–$C_{12}$ alkyl, or $R_2$ is $C_{12}$–$C_{16}$ alkyl and $R_3$ is benzyl; and $X^-$ is halide; and (D) water, wherein, based on the total weight of A, B, C and D, components A, B and C comprise from 30 to 50 weight percent and wherein the ratio of A:B:C in said medium is in the range from 2:4:1 to 3.5:5:1, said components A, B and C being present in the wash medium at dilutions from 1:213 to 1:2133.

11. A method according to claim 10 comprising laundering said fabrics with a stable liquid laundry detergent concentrate composition additionally comprising up to about 13 total weight percent of foam/stabilizer/anti-irritant agents, brighteners, fragrances and dyes.

12. The method according to claim 10 where R is tridecyl.

13. The method according to claim 11 where R is tridecyl, and wherein about 0.45% of dimethyl cocoamine-N-oxide is included as a foam stabilizer/anti-irritant.

14. The method according to claim 12 which comprises laundering said fabrics with a stable liquid laundry detergent concentrate composition comprising (A) about 10 weight percent of an ethoxylated nonyl and octyl phenol of formula Ia/Ib where x is 9–10; (B) about 20 weight percent of sodium trideceth-7-carboxylate of the formula $C_{13}H_{27}O(CH_2CH_2O)_6OCH_2COONa$; and (C) about 5 weight percent of a quaternary ammonium germicide of formula III containing about 40 weight percent of an alkyl dimethyl benzylammonium chloride (50% $C_{14}$, 40% $C_{12}$ and 10% $C_{16}$ alkyl); about 30 weight percent of octyl decyl dimethylammonium chloride; about 15 weight percent of dioctyl dimethylammonium chloride; and about 15 weight percent of didecyl dimethyl ammonium chloride and the balance water.

15. The method according to claim 13 which comprises laundering said fabrics with a stable liquid laundry detergent concentrate composition comprising (A) about 10 weight percent of an ethoxylated nonyl and octyl phenol of formula Ia/Ib where x is 9–10; (B) about 20 weight percent of sodium trideceth-7-carboxylate of the formula $C_{13}H_{27}O(CH_2CH_2O)_6OCH_2COONa$; (C) about 4 weight percent of a quaternary ammonium germicide of formula III containing about 40 weight percent of an alkyl dimethyl benzylammonium chloride (50% $C_{14}$, 40% $C_{12}$ and 10% $C_{16}$ alkyl); about 30.0 weight percent of octyl decyl dimethylammonium chloride; about 15.0 weight percent of dioctyl dimethylammonium chloride; and about 15 weight percent of didecyl dimethylammonium chloride; and other ingredients comprising about 0.45 weight percent of dimethyl cocoamine-N-oxide, about 0.07 weight percent of a brightener, about 0.5 weight percent of a fragrance oil and about 0.002 weight percent of a dye.

16. The method according to claim 11 which comprises laundering said fabrics with a stable liquid laundry detergent concentrate composition comprising (A) about 18 weight percent of an ethoxylated nonyl and octyl phenol of formula Ia/Ib where x is 9–10; (B) about 21.5 weight percent of sodium trideceth-7-carboxylate of the formula $C_{13}H_{27}O(CH_2CH_2O)_6OCH_2COONa$; (C) about 5.6 weight percent of an alkyl dimethyl benzylammonium chloride (50% $C_{14}$, 40% $C_{12}$, 10% $C_{16}$ alkyl); and other ingredients comprising about 0.36 weight percent of a brightener, about 1 weight percent of triethylamine, about 4 weight percent of ethanol, about 0.5 weight percent of a fragrance oil and about 0.008 weight percent of a dye.

17. The method according to claim 11 which comprises laundering said fabrics with a stable liquid laundry detergent concentrate composition comprising (A) about 18 weight percent of an ethoxylated nonyl and octyl phenol of formula Ia/Ib where x is 9–10; (B) about 21.5 weight percent of sodium trideceth-7-carboxylate of the formula $C_{13}H_{27}O(CH_2CH_2O)_6OCH_2COONa$; (C) about 5.6 weight percent of an alkyl dimethyl benzylammonium chloride (50% $C_{14}$, 40% $C_{12}$, 10% $C_{16}$ alkyl); and other ingredients comprising about 0.36 weight percent of a brightener, about 1.0 weight percent of ethylenediaminetetraacetic acid, about 4.0 weight percent of ethanol, about 0.5 weight percent of a fragrance oil and about 0.008 weight percent of a dye.

18. The metod according to claim 11 which comprises laundering said fabrics with a stable liquid laundry detergent concentrate composition comprising (A) about 18 weight percent of an ethoxylated nonyl and octyl phenol of formula Ia/Ib where x is 9–10; (B) about 21.5 weight percent of sodium trideceth-7-carboxylate of the formula $C_{13}H_{27}O(CH_2CH_2O)_6OCH_2COONa$; (C) about 5.6 weight percent of an alkyl dimethyl benzylammonium chloride (50% $C_{14}$, 40% $C_{12}$, 10% $C_{16}$ alkyl); and other ingredients comprising about 5.0 weight percent of trisodium nitrilotriacetate, about 0.36 weight percent of a brightener, about 1.0 weight percent of triethylamine, about 4.0 weight percent of ethanol, about 0.5 weight percent of a fragrance oil and about 0.008 weight percent of a dye.

* * * * *

UNITED STATES PATENT AND TRADEMARK OFFICE

CERTIFICATE OF CORRECTION

PATENT NO. : 4,576,729

DATED : March 18, 1986

INVENTOR(S) : Leon E Paszek and Barbara Gebbia

It is certified that error appears in the above-identified patent and that said Letters Patent is hereby corrected as shown below:

Claim 1, column 8, lines 12 and 13, change "and composition" to read — said composition —.

Claim 18, column 12, line 27, change "metod" to read — method —.

Signed and Sealed this

Tenth Day of March, 1987

*Attest:*

*Attesting Officer*

DONALD J. QUIGG

*Commissioner of Patents and Trademarks*